United States Patent [19]

Pikoń et al.

[11] 3,988,210

[45] Oct. 26, 1976

[54] FURNACE FOR MANUFACTURING HIGH CALORIFIC GAS AND COKE FROM COAL

[75] Inventors: Jerzy Pikoń; Piotr Wasilewski, both of Gliwice; Boleslaw Mitka, Katowice, all of Poland

[73] Assignee: Politechnika Slaska im Wincentego Pstrowskiego, Gliwice, Poland

[22] Filed: Feb. 28, 1975

[21] Appl. No.: 554,214

[52] U.S. Cl. ..... 202/108; 202/109; 202/119; 202/116; 23/277 R; 48/101

[51] Int. Cl.[2] ..... C10B 1/00

[58] Field of Search ..... 202/117, 108, 109, 119, 202/233, 113, 114, 116; 23/277 R; 48/101, 123, 113

[56] References Cited

UNITED STATES PATENTS

| | | | |
|---|---|---|---|
| 2,066,082 | 12/1936 | Vandergrift | 202/114 |
| 2,550,677 | 5/1951 | Dalin | 202/114 |
| 3,108,930 | 10/1963 | Brandberg | 202/114 |
| 3,734,833 | 5/1973 | Singh | 202/114 |

*Primary Examiner*—Hiram H. Bernstein
*Attorney, Agent, or Firm*—Haseltine, Lake & Waters

[57] ABSTRACT

A furnace for manufacturing a high-calorific gas and coke from coal, provided with two walls 1 perforated in their upper portion, which form a rectangular chamber 2 filled with a coal charge. These walls are provided with channels 3 with inlet pipes 4 for supplying hot combustion gases and the furnace is furnished in its upper zone with inlet pipes 6 for delivering coal to the furnace and ramming pistons 7 having imparted free reciprocating motions. At the side of the furnace in its upper zone are inlet pipes 8 for supplying a hot circulating gas to the direct heating chamber where a coal charge is directly heated. Inside of the gas chamber 10 of the furnace there is an outlet pipe 9 for withdrawing cold circulating gas to a blower 14, which then becomes successively heated to the required temperature in a heat exchanger 13.

2 Claims, 2 Drawing Figures

FURNACE FOR MANUFACTURING HIGH CALORIFIC GAS AND COKE FROM COAL

Figure 1:
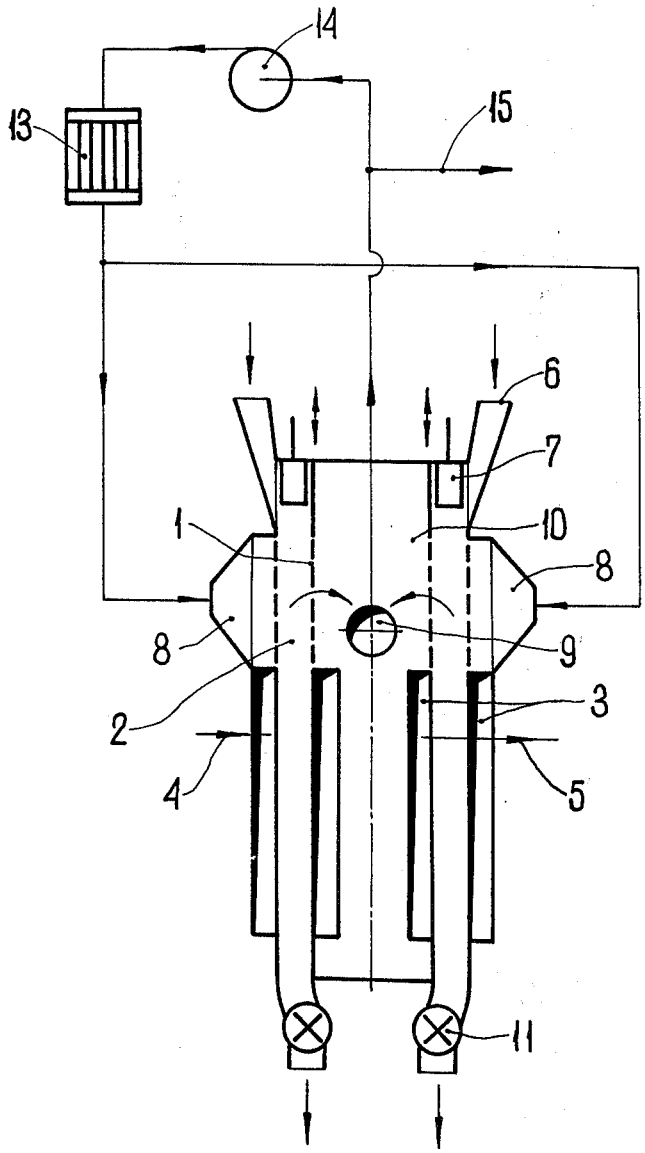

The invention relates to a furnace for manufacturing high-calorific gas and coke from coal.

The conventional furnaces hitherto used for manufacturing high-calorific gas and coke from coal are of various types such as chamber ovens, Lurga's type furnaces, stoker furnaces, tunnel kilns and rotary furnaces.

However all these furnaces appeared to be not economical, due to their complicated constructions and long period of coking. The known furnace of Lurga's type has a rotary stoker. This furnace produces low calorific gases, because the coal charge is heated with combustion gases, which cause dilution of the produced gases.

Although furnaces with a fluidized bed and furnaces with a solid heating medium enable quick degassing of coal, the technological process in said furnaces is difficult and burdensome to carry out.

In most furnaces the coal degassing process is carried out by means of indirect heating, which makes heat flow and obtaining high coking rates difficult. The permeable partition in the form of a ceramic wall offers a great resistance to the heat flow.

In the fluidized-bed furnaces really high coking rates can be obtained, but due to continuous mutual movements of the coal grains which strike one another the obtained quick-coke is small sized and thus unfit for use in blast furnace processes.

Also the furnaces with travelling grates do not give coke of high quality. The use of a solid heating medium for heating the coal is troublesome also, because such a system requires special conveyors and means for separating the heating medium from the coal body. In coking batteries commonly used for coal degassing the coking process averages about 20 hours, the coking rate is low and the process operation burdensome due to periodic run of coking chambers. Moreover the periodic run of coking chambers involves a serious problem of dusting and smogging of the atmosphere resulting in great loss of heat to the environment. The periodic run of coking batteries also causes much trouble in introducing mechanization and automation to coking processes.

The present invention aims at providing a furnace, which will reduce or overcome the disadvantages of former furnaces.

A furnace according to the invention for the manufacture of a high-calorific gas and coke from coal comprises two walls which are perforated in their upper portion and imperforated in the lower portion, said walls form a rectangular chamber filled with a coal charge. Walls are provided with channels to which combustion gases are supplied and withdrawn respectively by means of pipes. In the upper zone of the furnace there are pipes for delivering coal to the furnace and reciprocating ramming pistons. At the side of the furnace in its upper zone are pipes which feed the circulating gas obtained from degassing the coal for directly heating the coal charge. This system enables obtaining high-calorific gases (about 7000 kcal/Nm$^3$). Inside the furnace chamber there is an outlet pipe for withdrawing the circulating gas.

In the embodiment which constitutes a variant of the invention the circulating gas flows twice through a coal body and the walls are perforated also in their bottom portion and are provided with outlet pipes for withdrawing the circulating gas to the blower.

A furnace according to the invention for the manufacture of a high-calorific gas and coke from coal enables quicker degassing of coal in comparison with known coking batteries, without previous disadvantages, providing simplification of the construction, continuity of the process, mechanization and automation of the whole assembly and elimination of air pollution.

Figure 2:
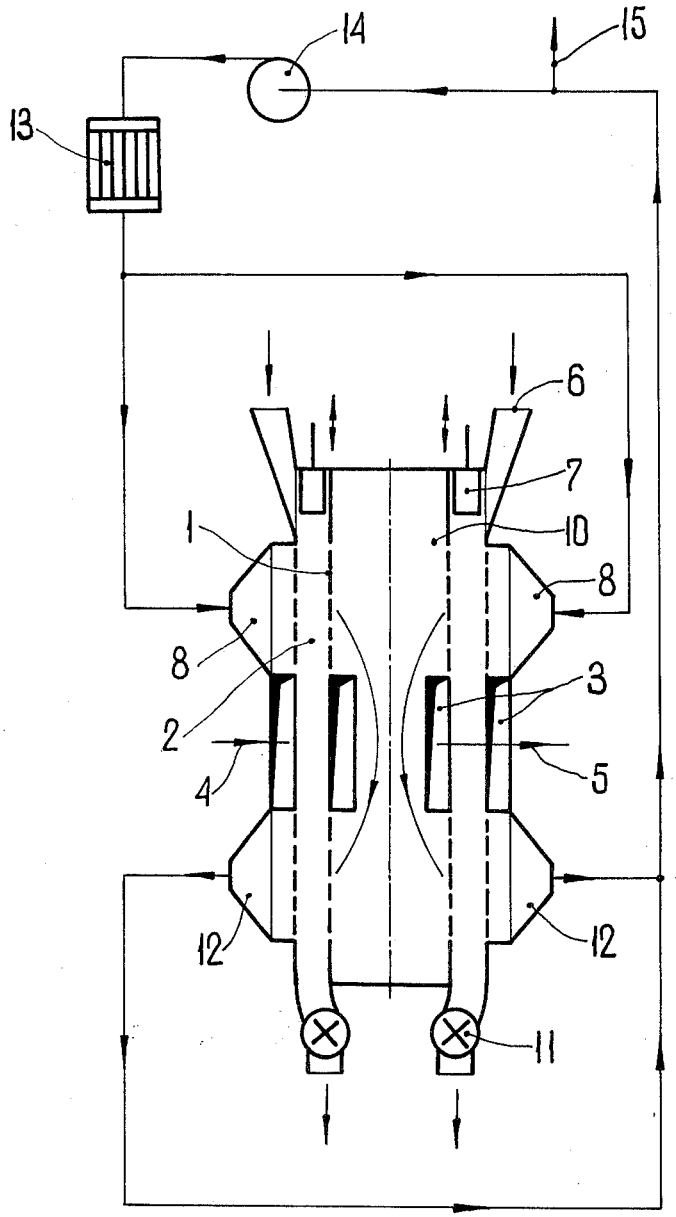

An embodiment of the invention is shown by way of example with reference to the accompanying drawing in which FIG. 1 presents a vertical sectional view of the furnace with a single flow of a circulating gas, FIG. 2 presents a vertical sectional view of the furnace, being a variant of the invention, with a double flow of a circulating gas.

A furnace is provided with two walls 1 perforated in the upper portion which form a rectangular chamber 2 filled with a coal charge. Walls 1 are provided with channels 3 to which hot combustion gases are supplied by pipes 4 and cold combustion gases are withdrawn by pipes 5.

In the upper zone of the furnace are pipes 6 for delivering the coal to the furnace and reciprocating pistons 7. In the upper zone of the furnace at its side are pipes 8 for supplying a hot circulating gas to a heat exchanger 13 serving for directly heating the furnace and inside of the gas chamber 10 is pipe 9 for withdrawing a cold circulating gas. Dosers 11 are provided for discharging the coke or quick-coke from the furnace.

In the case of applying a double flow of circulating gas through a coal charge, which presents a variant of the invention walls 1 are perforated in their upper and lower portions and furnished with pipes 12 for withdrawing a cold circulating gas to a blower 14.

The furnace according to the invention is operated in the following manner: coal is delivered to the upper heating zone of the furnace by pipes 6, disposed between two walls 1, which form a rectangular chamber 2. The furnace is indirectly heated by means of combustion gases being fed to channels 3 by pipe 4. Combustion gases flowing through channels 3 of the furnace flow over the walls of the chamber 2 resulting in heating of said chamber. The cooled combustion gases leave the furnace by pipes 5. The ramming pistons 7 are moving with reciprocating motion by means of a mechanism (not shown in the drawing). Coal is delivered to the furnace when pistons 7 are in the top position. The reciprocating motion of the piston 7 and the force of gravity cause the coal to move down through the upper zone of the furnace, where the coal charge becomes directly heated to the plasticizing state. Then the coal charge descends down through the central heating zone of the furnace, being indirectly heated, where the coal is converted into coke or quick-coke. The coke is withdrawn from the furnace by dosers 11.

The walls of the chamber 1 can be parallel or divergent in relation to axis of the furnace at a plane angle, thus the chamber 2 which is filled with coal is wider in its bottom portion, what prevents the coal from clogging in the furnace. The circulating heating gas is fed to the upper zone of the furnace by pipes 8, then passes through the coal body to the gas chamber 10, wherefrom it flows out from the furnace by pipes 9 to heat exchangers 13 where said gas becomes progressively hotter. Then the gas after being heated and compressed in the blower 14 is directed to the furnace again as circulating gas, being now used for directly heating the coal charge in the upper zone of the furnace. An excess of said gas is withdrawn by a pipe 15.

In FIG. 2 a variant of the invention is shown, wherein the circulating gas flows twice through the coal body. This furnace is provided with pipes 12 for withdrawing the cold circulating gas and the walls 1 are perforated in the upper and lower portions of the furnace.

What we claim is:

1. A furnace for manufacturing a high-calorific gas and coke from coal, which comprises: two walls perforated in the upper portion, forming a rectangular chamber filled with a coal charge, provided in its lower imperforated portion with channels having first inlet pipes for supplying hot combustion gases in order to heat indirectly the lower portion of said chamber and first outlet pipes for withdrawing cold combustion gases to the atmosphere, said furnace being provided in its upper zone with second inlet pipes for delivering coal to the furnace and ramming pistons having imparted free reciprocating motion, said furnace also being provided at the side in its upper perforated portion with third inlet pipes for supplying hot circulating gas as the direct heating means to the upper perforated portion of said rectangular chamber and with second outlet pipes disposed within the gas chamber defined by the outer surface of the inner walls of said rectangular chamber for withdrawing cold circulating gas to a blower and thence to a heat exchanger for reheating the cold circulating gas and means for supplying said reheated circulating gas to said third inlet pipe.

2. A furnace for manufacturing a high calorific gas and coke from coal, which comprises two walls perforated in the upper and lower portions, and imperforated in the middle portion forming a rectangular chamber filled with a coal charge, wherein said imperforated portion is provided with channels with first inlet pipes for supplying hot combustion gases for indirect heating and first outlet pipes for withdrawing cold combustion gases to the atmosphere, said furnace being provided in its upper zone with second inlet pipes for delivering coal to the furnace and ramming pistons having imparted free reciprocating motion, said furnace also being provided at the side in its upper perforated with third inlet pipes for feeding hot circulating gas as the direct heating means to the upper perforated portion of said rectangular chamber and at the side in its lower perforated portion with second outlet pipes for withdrawing cold circulating gas to a blower and thence to a heat exchanger for reheating the cold circulating gas and means for supplying said reheated circulating gas to said third inlet pipe.

* * * * *